US008967987B2

(12) United States Patent
Park et al.

(10) Patent No.: US 8,967,987 B2
(45) **Date of Patent: *Mar. 3, 2015**

(54) SCROLL COMPRESSOR HAVING AT LEAST ONE BYPASS HOLE

(75) Inventors: Junghoon Park, Changwon-si (KR); Sungsoon Jang, Changwon-si (KR); Jeonghun Kim, Changwon-si (KR); Nara Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 222 days.

This patent is subject to a terminal disclaimer.

(21) Appl. No.: 13/555,385

(22) Filed: Jul. 23, 2012

(65) Prior Publication Data

US 2013/0022486 A1 Jan. 24, 2013

(30) Foreign Application Priority Data

Jul. 22, 2011 (KR) ..... 10-2011-0073297

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 18/02*** | (2006.01) |
| ***F04C 23/00*** | (2006.01) |
| *F04C 28/26* | (2006.01) |
| *F04C 28/28* | (2006.01) |

(52) U.S. Cl.

CPC ..... *F04C 18/0261* (2013.01); *F04C 23/008* (2013.01); *F04C 18/0215* (2013.01); *F04C 28/26* (2013.01); *F04C 28/28* (2013.01)

USPC ..... 418/55.5; 418/15; 418/55.1; 418/55.2; 418/57; 418/180

(58) Field of Classification Search

USPC ..... 418/15, 55.1–55.6, 57, 180; 417/310

See application file for complete search history.

(56) References Cited

U.S. PATENT DOCUMENTS

| | | | | |
|---|---|---|---|---|
| 4,774,816 | A * | 10/1988 | Uchikawa et al. | 418/55.1 |
| 6,273,691 | B1 * | 8/2001 | Morimoto et al. | 418/15 |
| 7,938,634 | B2 * | 5/2011 | Sun | 418/55.5 |
| 8,672,655 | B2 * | 3/2014 | Kim et al. | 418/55.1 |
| 2010/0221133 | A1 * | 9/2010 | Nishikawa et al. | 418/55.1 |

FOREIGN PATENT DOCUMENTS

| | | |
|---|---|---|
| JP | 9195960 | 7/1997 |

OTHER PUBLICATIONS

Korean Office Action dated Nov. 23, 2012.

* cited by examiner

*Primary Examiner* — Theresa Trieu
(74) *Attorney, Agent, or Firm* — Ked & Associates, LLP

(57) ABSTRACT

A scroll compressor is provided, in which at least one bypass hole that bypass a portion of a refrigerant before the refrigerant is discharged through a discharge hole is formed at a position where a bypass section that bypasses the refrigerant through the at least one bypass hole overlaps a discharge section that discharges the refrigerant through the discharge hole. The at least one bypass hole is formed at a position where a wrap volume ratio (Vs/Vd), which is a ratio of a suction volume (Vs) with respect to a discharge volume (Vd) in a compression chamber, is within the range of about 1.8~2.2. With this configuration, over-compression of refrigerant may be prevented in a low speed driving mode, and efficiency of the compressor may be enhanced in the low speed driving mode and under a low load condition.

21 Claims, 8 Drawing Sheets

| DIVISION | EER UNDER F CONDITION | REMARKS |
|---|---|---|
| WHEN WRAP VR IS LESS THAN 1.8 | 40.9 | |
| WHEN WRAP VR IS WITHIN THE RANGE OF 1.8~2.2 | 43.5 | OPTIMUM WRAP VR SECTION |
| WHEN WRAP VR IS MORE THAN 2.2 | 40.7 | |

SCROLL COMPRESSOR HAVING AT LEAST ONE BYPASS HOLE

CROSS-REFERENCE TO RELATED APPLICATION(S)

Pursuant to 35 U.S.C. §119(a), this application claims priority to Korean Application No. 10-2011-0073297, filed in Korea on Jul. 22, 2011, the contents of which are incorporated by reference herein in its entirety.

BACKGROUND

1. Field

A scroll compressor is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
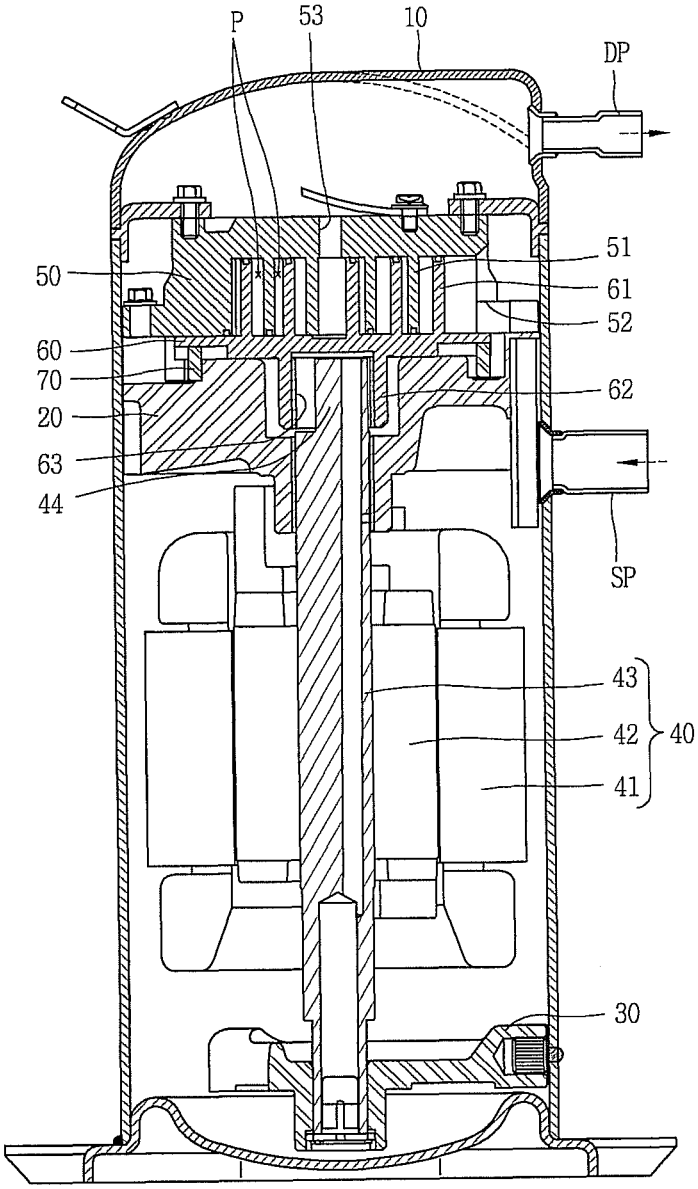
FIG. 1 is a longitudinal sectional view of a variable radius type scroll compressor according to an embodiment.

Hereinafter, a scroll compressor according to embodiments will be explained in more details with reference to the attached drawings. Where possible, like reference numerals have been used to indicate like elements, and repetitive disclosure has been omitted.

A scroll compressor is an apparatus that compresses a refrigerant by changing a volume of compression chambers formed by a pair of scrolls that face each other. When compared with a reciprocating compressor or a rotary compressor, the scroll compressor has higher efficiency, lower vibration and noise, a smaller size, and a lighter weight. Accordingly, the scroll compressor is being widely applied to air conditioning systems.

The scroll compressor may be categorized as a constant speed type scroll compressor and an inverter type scroll compressor according to a driving method of a driving motor. The constant speed type scroll compressor indicates a compressor having the same driving speed regardless of a load change, whereas the inverter type scroll compressor indicates a compressor having a driving speed variable according to a load change.

The constant speed type scroll compressor is designed to have a wrap volume ratio that minimizes an over-compression loss under any load condition of a refrigerating cycle apparatus. However, the conventional constant speed type scroll compressor may have the following problems.

That is, the conventional constant speed type scroll compressor has a small over-compression loss under a high load condition of a refrigerating cycle apparatus. On the other hand, the conventional constant speed type scroll compressor has a large over-compression loss under a low load condition of a refrigerating cycle apparatus. Accordingly, if the inverter type scroll compressor is designed to have the same wrap volume ratio as that of the constant speed type scroll compressor, efficiency of the compressor is degraded under a low load condition. That is, since the inverter type scroll compressor has a driving speed variable according to a load change, a design degree of freedom of a wrap volume ratio is higher than that of the constant speed type scroll compressor. However, when the inverter type scroll compressor is designed to have the same wrap volume ratio as that of the constant speed type scroll compressor, an over-compression occurs under a low load condition, degrading efficiency of the compressor.

Figure 2:
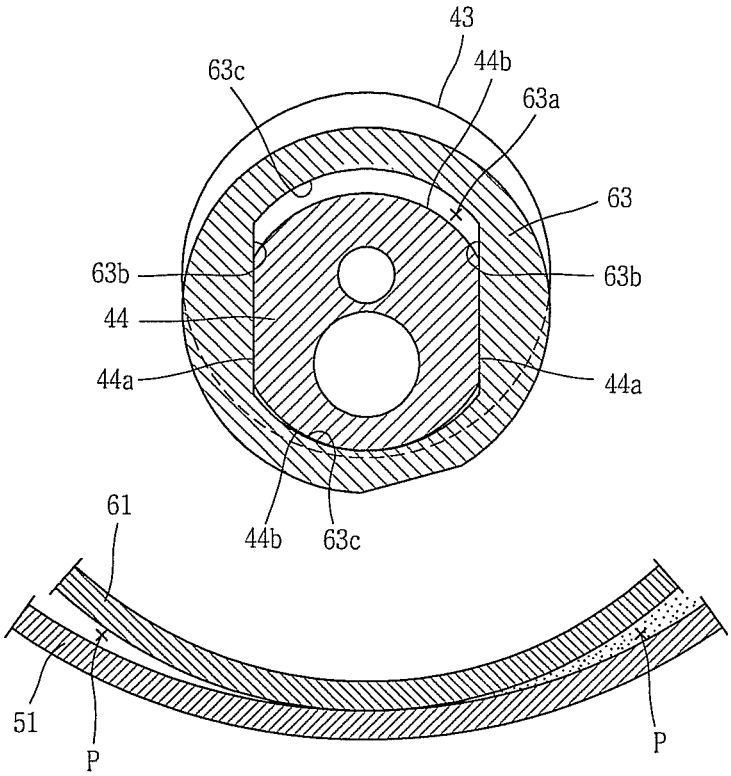
FIGS. 2 and 3 are schematic views illustrating a sealing status and a leakage status, respectively, in a radius direction of the scroll compressor of FIG. 1.
Figure 3:
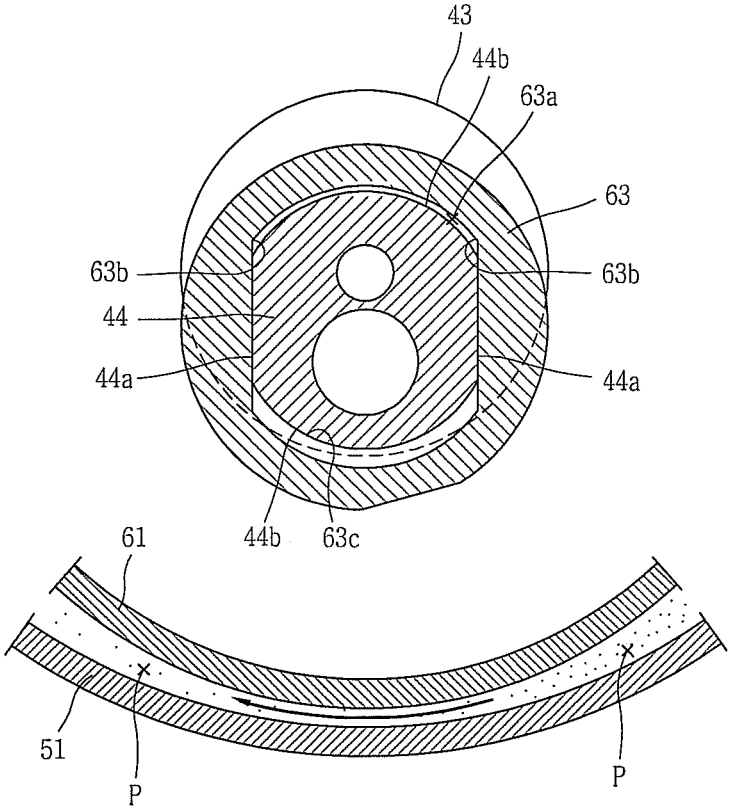

FIG. 1 is a longitudinal sectional view of a variable radius type scroll compressor according to an embodiment, and FIGS. 2 and 3 are schematic views illustrating a sealing status and a leakage status, respectively, in a radius direction of the scroll compressor of FIG. 1.

As shown in FIGS. 1 to 3, a main frame 20 and a sub frame 30 may be installed in a hermetic container 10, along with a driving motor 40, a driving force transmission part being installed between the main frame 20 and the sub frame 30. A compression apparatus, including a fixed scroll 50 and an orbiting scroll 60, and configured to compress a refrigerant by being coupled to the driving motor 40, may be installed above the main frame 20.

The driving motor 40 may include a stator 41, on which a coil may be wound, a rotor 42 rotatably inserted into the stator 41, and a crank shaft 43 forcibly-inserted into a center of the rotor 42, that transmits a rotational force to the compression apparatus. A driving pin 44 may protrude from an upper end of the crank shaft 43 so as to be eccentric with respect to a rotational center of the crank shaft 43.

The driving pin 44 may be formed in a rectangular shape. Two side surfaces 44*a* of the driving pin 44 may be planar so as to slidably contact sliding surfaces 63*b* of a sliding bush 63 to be explained later. Front and rear surfaces 44*b* of the driving pin 44 may be curved. Alternatively, the front and rear surfaces 44*b* of the driving pin 44 may be planar. However when edges of the driving pin 44 connected to the two side surfaces 44*a* are angular, abrasion may occur at a sliding recess 63*a* of the sliding bush 63. Accordingly, edges of the driving pin 44 may be formed in a curved shape when both the front and rear surfaces 44*b* of the driving pin 44 are either curved or planar.

The compression apparatus may include the fixed scroll 50, which may be fixed to an upper surface of the main frame 20, the orbiting scroll 60, which may be disposed on an upper surface of the main frame 20 so as to be engaged with the fixed scroll 50, and an Oldham's ring 70 disposed between the orbiting scroll 60 and the main frame 20 that prevents rotation of the orbiting scroll 60.

A fixed wrap 51, which forms a compression chamber(s) (P) together with an orbiting wrap 61 to be explained later by being spirally wound, may be formed on the fixed scroll 50.

The orbiting wrap 61, which forms the compression chamber(s) (P) by being engaged with the fixed wrap 51 by being spirally wound, may be formed on the orbiting scroll 60. A boss portion 62 coupled to the crank shaft 43 that receives a rotational force therefrom may protrude from a bottom surface of the orbiting scroll 60, i.e., an opposite side surface to the orbiting wrap 61.

The sliding bush 63 slidably coupled to the driving pin 44 of the crank shaft 43 in a radius direction may be slidably coupled to the boss portion 62 of the orbiting scroll 60 in a rotational direction. An outer diameter of the sliding bush 63 may be formed to be approximately the same as an inner diameter of the boss portion 62 of the orbiting scroll 60, and sliding recess 63*a*, which may have a rectangular shape, may be formed at a central region of the sliding bush 63 such that the driving pin 44 of the crank shaft 43 may slide in a radius direction.

The sliding recess 63*a* may be formed to have the same shape and length as the driving pin 44, approximately. The two sliding surfaces 63*b* of the sliding recess 63*a* may be planar like the two side surfaces 44*a* of the driving pin 44. On the other hand, front and rear stopper surfaces 63*c* of the sliding recess 63*a* may be curved or planar like the front and rear surfaces 44*b* of the driving pin 44.

Reference numeral 52 indicates a suction hole, reference numeral 53 indicates a discharge hole, reference numeral SP indicates a suction pipe, and reference numeral DP indicates a discharge pipe.

An operation and effect of the scroll compressor according to embodiments will be explained herein below.

Once the crank shaft 43 is rotated as power is applied to the driving motor 40, the orbiting scroll 60 eccentrically-coupled to the crank shaft 43 may perform an orbiting motion along a predetermined orbit. The compression chamber(s) (P) formed between the orbiting scroll 60 and the fixed scroll 50 may be consecutively moved towards a center of an orbiting motion to have a decreased volume, thereby consecutively sucking, compressing, and discharging a refrigerant.

When the compressor is initially driven as shown in FIG. 2, a gas force of the compression chamber(s) (P) is lower than a centrifugal force of the orbiting scroll 60. Accordingly, the orbiting scroll 60 tends to move to the outside due to centrifugal force. As the sliding bush 63 coupled to the orbiting scroll 60 is slidably coupled to the driving pin 44 of the crank shaft 43, the orbiting scroll 60 is slidably moved in a centrifugal direction, i.e., an eccentric direction of the driving pin 44. During this process, the orbiting wrap 61 of the orbiting scroll 60 may contact the fixed wrap 51 of the fixed scroll 50 to stably form the compression chamber(s) (P), and consecutively move towards the center.

When the driving motor performs a high speed driving (e.g., speed more than approximately 35 Hz), the centrifugal force of the orbiting scroll 60 may be increased to increase an orbit radius of the orbiting scroll 60. As a result, the orbiting wrap 61 may be more closely adhered to the fixed wrap 51 to minimize leakage of refrigerant in a radius direction, thereby enhancing a function of the compressor. However, when the centrifugal force of the orbiting scroll 60 is more than a predetermined level, the orbiting wrap 61 may be excessively adhered to the fixed wrap 51. This may increase a frictional loss when an amount of oil to be supplied is deficient, thereby lowering performance of the compressor. In a severe case, the wraps may be damaged.

When the orbiting wrap 61 is excessively adhered to the fixed wrap 51 as the centrifugal force of the orbiting scroll 60 is increased, a gas force of the compression chamber(s) (P) may generate a repulsive force. By this repulsive force, the orbiting scroll 60 may receive a force in a centripetal force direction. Then, the orbiting scroll 60 may receive a centripetal force, and the orbiting wrap 61 may be moved in a direction spaced from the fixed wrap 51 by the sliding bush 63 and the driving pin 44 of the crank shaft 43. As a result, leakage of refrigerant may occur in a radius direction, and thus, a frictional loss between the orbiting wrap 61 and the fixed wrap 51 may be reduced.

On the other hand, when the driving motor 40 performs a low speed driving (e.g., speed less than approximately 35 Hz), the centrifugal force of the orbiting scroll 60 may be small to decrease an orbit radius of the orbiting scroll 60. Accordingly, the orbiting wrap 61 may be spaced from the fixed wrap 51, and thus, leakage of refrigerant may occur in a radius direction. In order to maintain a wrap volume ratio of the compression chamber(s) by a predetermined degree even in a low speed driving mode, starting angles and ending angles of the scrolls may be controlled. However, when a wrap volume ratio of an inverter type scroll compressor is designed to be the same as that of a constant speed type scroll compressor, efficiency of the compressor may be lowered under a low load condition. Embodiments disclosed herein set a position of a bypass hole so as to have an optimum wrap volume ratio, to reduce occurrence of over-compression even under a low load condition.

Figure 4:
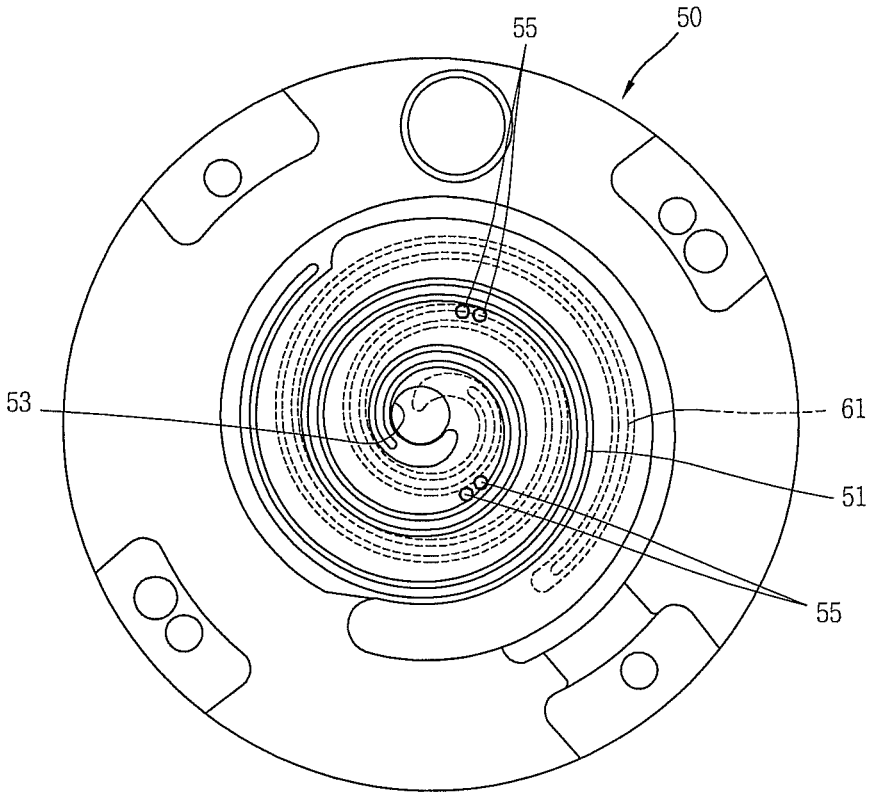
FIG. 4 is a planar view of a fixed scroll of the scroll compressor of FIG. 1, illustrating a position of a bypass hole(s)

Referring to FIG. 4, at least one bypass hole(s) 55 that partially bypasses a refrigerant compressed in an intermediate part on an orbit of the compression chamber(s) (P) may be formed in the fixed scroll 50. The at least one bypass hole(s) 55 may include a plurality of bypass holes 55. Further, the plurality of bypass holes 55 may be provided in pairs formed to correspond to two compression chambers (P), respectively. The bypass hole(s) 55 may be formed to have a diameter smaller than a width of the orbiting wrap 61, such that refrigerant does not leak between an inner compression chamber and an outer compression chamber.

The bypass hole(s) 55 may be formed at a position where a wrap volume ratio of the compression chamber(s) is in a range of approximately 1.8~2.2. That is, the bypass hole(s) 55 may be formed at a position where a ratio (Vs/Vd) of a suction volume (Vs) with respect to a discharge volume (Vd) in the compression chamber(s) (P) where a sucked refrigerant is compressed to be discharged therefrom, is in the range of about 1.8~2.2. More specifically, the bypass hole(s) 55 may be formed at a position where a section that bypasses the refrigerant through the bypass hole(s) 55 overlaps a section that discharges the refrigerant through the discharge hole 53.

Figure 5:
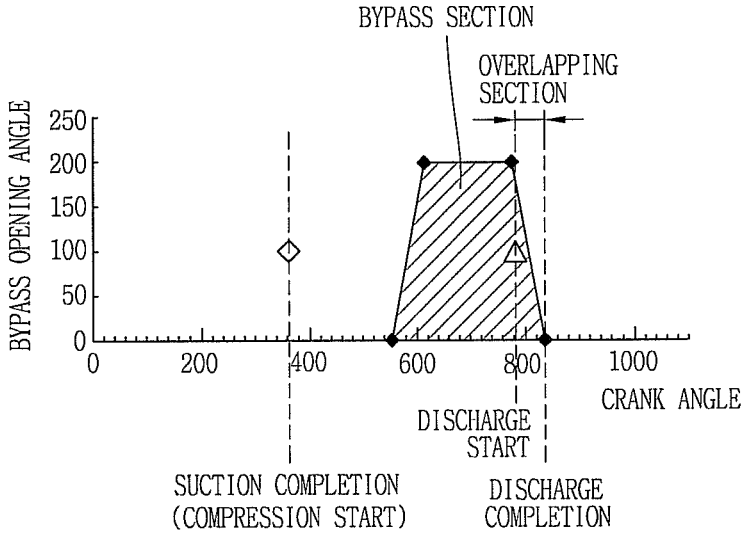
FIGS. 5 and 6 are schematic views illustrating an opening/closing section of the bypass hole(s) of FIG. 4.
Figure 6:
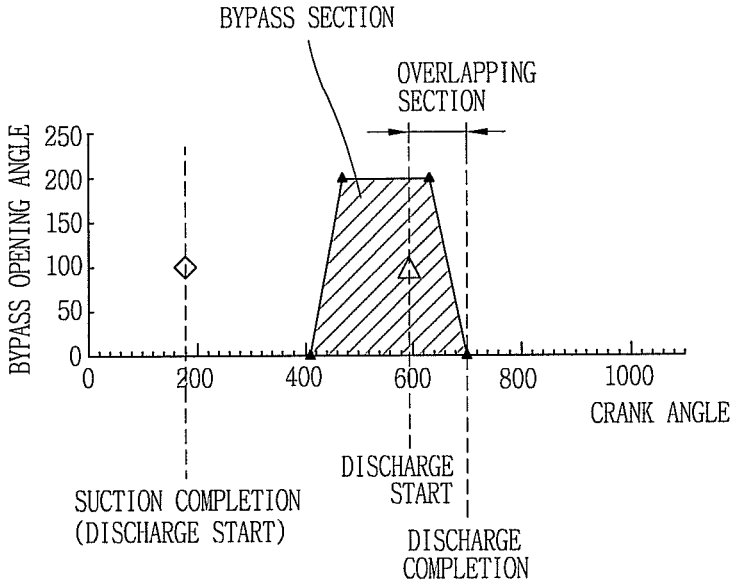

The bypass hole(s) 55 may be formed so as to be open at an angle of about 150°~250° based on a suction completion time point (i.e., compression starting angle), and so as to be closed at about 450°~550° based on the suction completion time point. More specifically, as shown in FIG. 5, when the compression chamber is formed at an outer side of the orbiting wrap 61, a crank angle may be formed to be open at about 560°, but to be closed at about 820°. On the other hand, referring to FIG. 6, when the compression chamber(s) is formed at an inner side of the orbiting wrap 61, the crank angle may be formed to be open at about 400°, but to be closed at about 720°.

An overlapping section between a section that bypasses the refrigerant through the bypass hole(s) 55 and a section that discharges the refrigerant through the discharge hole 53 may be formed at a position where a crank angle is within a range of about 20°~150°.

Figures 7, 8:
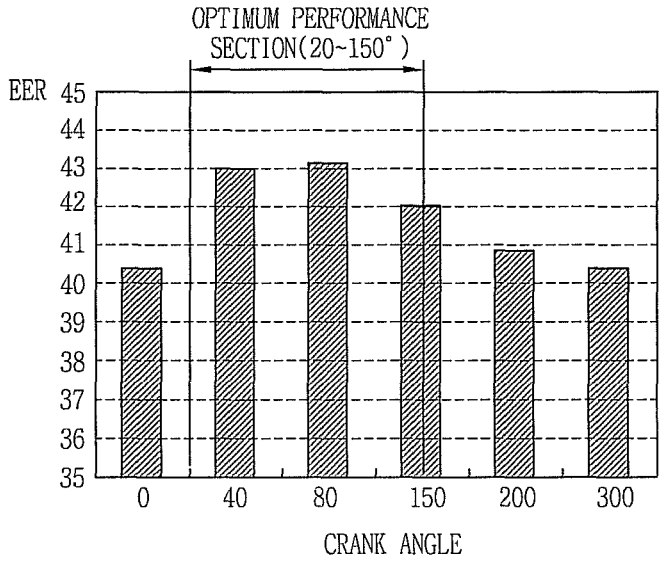
FIG. 7 is a graph illustrating a range of an overlapping section between a discharge hole position (discharge start angle) and a bypass hole section, for setting an optimum position of a bypass hole(s) according to embodiments.
FIG. 8 is an experimental table illustrating grounds for an optimum wrap volume ratio in a scroll compressor according to embodiments.

FIG. 7 is a graph illustrating a range of an overlapping section between a discharge hole position (discharge start angle) and a bypass hole opening section, for setting an optimum position of a bypass hole(s) according to embodiments. As shown in FIG. 7, performance (EER) of the compressor when the crank angle is approximately within the range of about 20°~150° is significantly higher than that when the crank angle is within other ranges. From FIG. 7, it can be seen that an overlapping section between a discharge hole position (discharge start angle) and a bypass hole opening section may be formed at a position where the crank angle is within the range of about 20°~150°.

Figure 9:
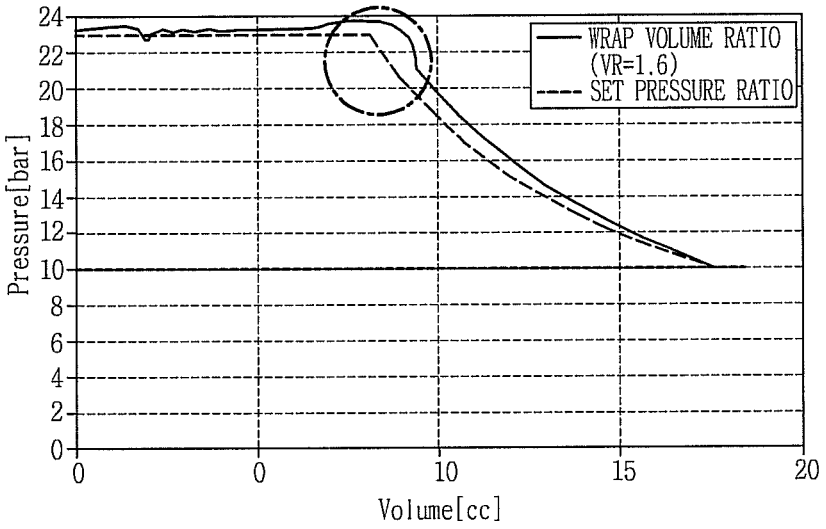
FIGS. 9 to 11 are graphs illustrating a difference between a wrap volume ratio and a set pressure ratio at each section in FIG. 8.
Figure 10:
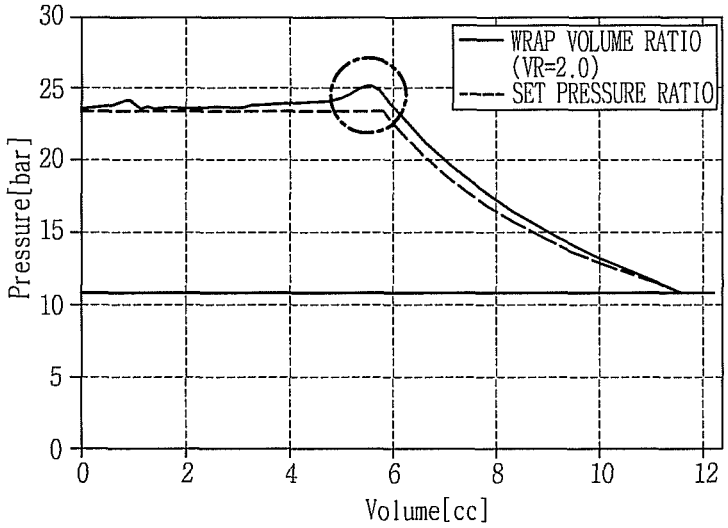
Figure 11:
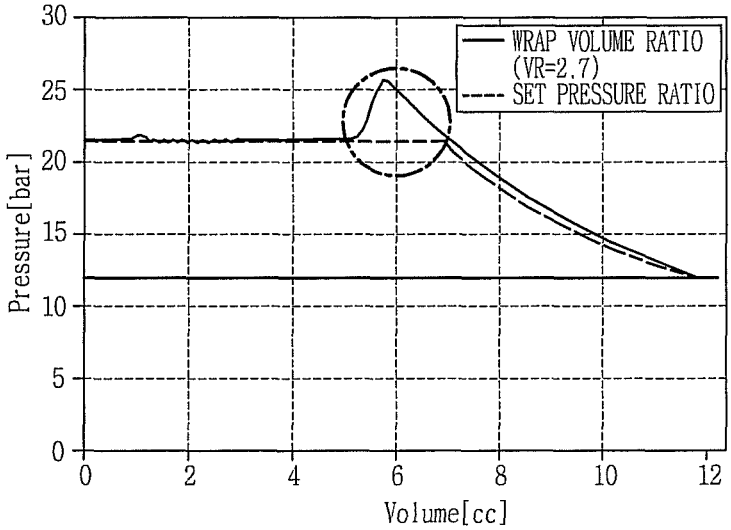

FIG. 8 is an experimental table illustrating grounds for an optimum wrap volume ratio in a scroll compressor according to, and FIGS. 9 to 11 are graphs illustrating a difference between a wrap volume ratio and a set pressure ratio at each section in FIG. 8.

Referring to FIG. 8, under conditions that a driving speed is about 30 Hz and a pressure ratio is about 1.49 (evaporator pressure is about 11.88 kgf/cm2 and condenser pressure is about 17.66 kgf/cm2), or under conditions that a driving speed is about 45 Hz and a pressure ratio is about 1.58 (evaporator pressure is about 11.22 kgf/cm2 and condenser pressure is about 17.76 kgf/cm2), when a wrap volume ratio is equal to or less than about 1.8, energy efficiency (EER) is about 40.9. When the wrap volume ratio is within the range of about 1.8~2.2, energy efficiency (EER) is about 43.5 under the same conditions. And, when the wrap volume ratio is equal to or more than about 2.2, energy efficiency (EER) is about 40.7 under the same conditions. From FIG. 8, it can be seen that optimum performance may be implemented when the wrap volume ratio is within the range of about 1.8~2.2.

Referring to FIG. 9, when the wrap volume ratio is about 1.6 and about 2.6, pressure loss may increase due to a large difference between a wrap volume ratio and set pressure. On the other hand, when the wrap volume ratio is about 2.0, pressure loss may decrease due to a small difference between a wrap volume ratio and set pressure.

As the bypass hole(s) is formed at a position where an overlapping section between the bypass section and the discharge section is implemented when a crank angle is within the range of about 20°~150°, over-compression of the compressor may be prevented in a low speed driving mode where a driving speed of the compressor is less than about 45 Hz. This may enhance efficiency of the compressor at a low speed driving mode and under a low load condition.

In the aforementioned embodiments, a symmetrical type scroll compressor is disclosed, in which the wraps of the scrolls are symmetrical to each other with the same length. However, embodiments may be also applied to a non-symmetrical scroll compressor, in which one of the plurality of scrolls has a wrap having a length which is longer than that of another scroll. Further, in the aforementioned embodiments, a variable radius type scroll compressor is disclosed. However, embodiments may be also applied to a fixed radius type scroll compressor. Furthermore, in the aforementioned embodiments, a low pressure type scroll compressor is disclosed. However, embodiments may be also applied to a high pressure type scroll compressor.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the embodiments described herein may be combined in various ways to obtain additional and/or alternative exemplary embodiments.

Embodiments disclosed herein provide a scroll compressor having an optimum wrap volume ratio such that occurrence of over-compression may be reduced under a low load condition.

Embodiments disclosed herein provide a scroll compressor that may include a plurality of scrolls having a plurality of wraps engaged to each other, one of the plurality of scrolls performing an orbiting motion with respect to the other of the plurality of scrolls, thereby forming a consecutively-moving compression chamber between the plurality of wraps. A wrap volume ratio (Vs/Vd), a ratio of a suction volume (Vs) with respect to a discharge volume (Vd), may be within a range of about 1.8~2.2.

Embodiments disclosed herein further provide a scroll compressor that may include a plurality of scrolls having a plurality of wraps engaged to each other, one of the plurality of scrolls performing an orbiting motion with respect to the other of the plurality of scrolls, thereby forming a consecutively-moving compression chamber between the plurality of wraps; and a bypass hole that bypasses part of a refrigerant before the refrigerant compressed in the compression chamber reaches a discharge hole. The bypass hole may be formed at a position where a bypass section that bypasses the refrigerant through the bypass hole overlaps a discharge section that discharges the refrigerant through the discharge hole.

Embodiments disclosed herein further provide a scroll compressor that may include a hermetic container; a driving motor installed at inner space of the hermetic container, having a variable speed, and having a crank shaft; a fixed scroll fixedly-coupled to an inner circumferential surface of the hermetic container at one side of the driving motor, and having a wrap of a prescribed height on one side surface thereof; an orbiting scroll having a wrap of a prescribed height on one side surface thereof so as to be engaged with the wrap of the fixed scroll, eccentrically-coupled to the crank shaft of the driving motor, and performing an orbiting motion with respect to the fixed scroll, such that a consecutively-moving compression chamber is formed between the wraps; and a sliding member configured to change an orbit radius of the orbiting scroll. The fixed scroll may be provided with a bypass hole that bypasses part of a refrigerant compressed in the compression chamber before the refrigerant reaches a discharge hole, and an overlapping section between the bypass hole and a discharge hole may be formed at a position where a crank angle is within the range of about 20°~150°.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a plurality of scrolls, which comprises a plurality of wraps engaged to each other, one of the plurality of scrolls performing an orbiting motion with respect to the other of the plurality of scrolls, thereby forming consecutively-moving compression chambers between the plurality of wraps; and at least one bypass hole that bypasses a portion of a refrigerant compressed in the compression chambers before the refrigerant reaches a discharge hole, wherein the at least one bypass hole is formed at a position where a wrap volume ratio (Vs/Vd), which is a ratio of a suction volume (Vs) with respect to a discharge volume (Vd), is within a range of about 1.8~2.2 and wherein the at least one bypass hole is formed at a position where an overlapping section between a bypass section that bypasses the refrigerant through the at least one bypass hole and a discharge section that discharges the refrigerant through the discharge hole is implemented when a crank angle is within a range of about 20°~150°.

2. The scroll compressor of claim 1, wherein the at least one bypass hole comprises a plurality of bypass holes.

3. The scroll compressor of claim 2, wherein the plurality of bypass holes is provided in pairs.

4. The scroll compressor of claim 2, wherein the plurality of bypass holes corresponds to two compression chambers of the compression chambers.

5. The scroll compressor of claim 1, wherein an orbiting speed of the scroll performing an orbiting motion is variable according to load.

6. The scroll compressor of claim 1, wherein the plurality of wraps of the plurality of scrolls has a same length.

7. The scroll compressor of claim 1, wherein in one of the plurality of scrolls has a wrap having a length longer than a length of a wrap of another of the plurality of scrolls.

8. A scroll compressor, comprising:

a plurality of scrolls, which comprises a plurality of wraps engaged to each other, one of the plurality of scrolls performing an orbiting motion with respect to the other of the plurality of scrolls, thereby forming consecutively-moving compression chambers between the plurality of wraps; and at least one bypass hole that bypasses a portion of a refrigerant compressed in the compression chambers before the refrigerant reaches a discharge hole, wherein the at least one bypass hole is formed at a position where a bypass section that bypasses the refrigerant through the at least one bypass hole overlaps a discharge section that discharges the refrigerant through the discharge hole, wherein the at least one bypass hole is formed at a position where an overlapping section between the bypass section and the discharge section is implemented when a crank angle is within a range of about 20°~150°.

9. The scroll compressor of claim 8, wherein the at least one bypass hole comprises a plurality of bypass holes.

10. The scroll compressor of claim 9, wherein the plurality of bypass holes is provided in pairs.

11. The scroll compressor of claim 9, wherein the plurality of bypass holes corresponds to two compression chambers of the compression chambers.

12. The scroll compressor of claim 8, wherein the at least one bypass hole is formed at a position where a wrap volume ratio (Vs/Vd), which is a ratio of a suction volume (Vs) with respect to a discharge volume (Vd), is within a range of about 1.8~2.2.

13. The scroll compressor of claim 8, wherein the plurality of wraps of the plurality of scrolls has a same length.

14. The scroll compressor of claim 8, wherein one of the plurality of scrolls has a wrap having a length longer than a length of a wrap of another of the plurality of scrolls.

15. A scroll compressor, comprising:

a hermetic container;

a driving motor installed at inner space of the hermetic container, having a variable speed, and having a crank shaft;

a fixed scroll fixedly-coupled to an inner circumferential surface of the hermetic container at one side of the driving motor, and having a wrap of a predetermined height on one side surface thereof;

an orbiting scroll having a wrap of a predetermined height on one side surface thereof so as to be engaged with the wrap of the fixed scroll, eccentrically-coupled to the crank shaft of the driving motor, and perform an orbiting motion with respect to the fixed scroll, such that consecutively-moving compression chambers are formed between the wraps; and a sliding member configured to change an orbit radius of the orbiting scroll, wherein the fixed scroll is provided with at least one bypass hole that bypasses a portion of a refrigerant compressed in the compression chambers before the refrigerant reaches a discharge hole, and wherein an overlapping section between the at least one bypass hole and the discharge hole is formed at a position where a crank angle is within a range of about 20°~150°.

16. The scroll compressor of claim 15, wherein the at least one bypass hole comprises a plurality of bypass holes.

17. The scroll compressor of claim 16, wherein the plurality of bypass holes is provided in pairs.

18. The scroll compressor of claim 16, wherein the plurality of bypass holes corresponds to two compression chambers of the compression chambers.

19. The scroll compressor of claim 15, wherein the at least one bypass hole is formed at a position where a wrap volume ratio (Vs/Vd), which is a ratio of a suction volume (Vs) with respect to a discharge volume (Vd) in the compression chambers, is within a range of about 1.8~2.2.

20. The scroll compressor of claim 15, wherein the wraps of the scrolls have a same length.

21. The scroll compressor of claim 15, wherein one of the scrolls has a wrap having a length longer than a length of the wrap of the other of the scrolls.

* * * * *